US005396141A

United States Patent [19]

Jantz et al.

[11] Patent Number: 5,396,141

[45] Date of Patent: Mar. 7, 1995

[54] RADIOISOTOPE POWER CELLS

[75] Inventors: Scott D. Jantz, Jacksonville, Fla.; Thomas J. Aton, Dallas, Tex.

[73] Assignee: Texas Instruments Incorporated, Dallas, Tex.

[21] Appl. No.: 99,894

[22] Filed: Jul. 30, 1993

[51] Int. Cl.[6] ..... G21H 1/06

[52] U.S. Cl. ..... 310/303; 136/253

[58] Field of Search ..... 136/248, 253; 310/303

[56] References Cited

U.S. PATENT DOCUMENTS

| | | | |
|---|---|---|---|
| 2,847,585 | 8/1958 | Christian | 310/303 |
| 3,706,893 | 12/1972 | Olsen et al. | 310/303 |
| 5,260,621 | 11/1993 | Little et al. | 310/303 |

FOREIGN PATENT DOCUMENTS

| | | | |
|---|---|---|---|
| 54-38783 | 3/1979 | Japan | 136/253 |

OTHER PUBLICATIONS

W. G. Pfann et al, *J. Appl. Phys.*, vol. 25, No. 11, No. 1954, pp. 1422–1434.

*Primary Examiner*—Aaron Weisstuch
*Attorney, Agent, or Firm*—Douglas A. Sorensen; Richard L. Donaldson; William E. Hiller

[57] ABSTRACT

An electrical power source or power cell (10) includes a semiconductor material (12) having an N region (14), a P region (16) and a P-N junction (18). A radioactive source (24) associates with P-N junction (18) and emits energy or radioactive particles (26) into semiconductor material (12). In semiconductor material (12), electron-hole pairs are formed in N region (14) and P region (16) to cause electrical current to pass through P-N junction (18) and produce, therefrom, electrical power.

5 Claims, 1 Drawing Sheet

RADIOISOTOPE POWER CELLS

TECHNICAL FIELD OF THE INVENTION

The present invention generally relates to electrical power sources for electronic circuitry and, more particularly, to a method and apparatus for generating electrical power that employ radioisotope power cells.

BACKGROUND OF THE INVENTION

Decay of radioactive materials produces electrically charged radioactive particles such as $\alpha$ particles, $\beta$ particles, and $\gamma$ particles. As with other nuclear processes, the charge scale of these types of radiation is millions of times greater than in non-nuclear processes. For example, $\alpha$ decay of the $Am_{241}$ radioisotope has a half-life of 458 years and can introduce 5.5 million electron volts (MeV) into a typical semiconductor material. On the average, however, 3.6 electron volts (eV) are necessary to produce one electron-hole pair the typical semiconductor material. Thus, for every $\alpha$ particle traveling through the semiconductor material approximately 1.53 million electron-hole pairs may be formed. In contrast, for a typical photo-cell each photon that is absorbed by a photon-responsive semiconductor material generates only one electron-hole pair. If a method and apparatus existed to harness the power that comes from atomic particles, then this energy could be used for a variety of power applications.

SUMMARY OF THE INVENTION

There is a need, therefore, for a method and apparatus in the form of a radioisotope-based electrical power source. The present invention, accordingly, provides a radioisotope power source in the form of radioisotope power cells using P-N junctions in a semiconductor material that provides a heretofore unavailable source of power to energize electronic circuits.

The radioisotope power cell of the present invention provides an electrical power source that includes a semiconductor material and at least one P-N junction within the semiconductor material. A radioisotope or radioactive source associates with the P-N junction and emits electrically-charged radioactive particles into the semiconductor material near the P-N junction. The P-N junction receives the electrically-charged radioactive particles to generate electron-hole pairs therefrom and produce electrical current across the P-N junction. The electrical power source of the present invention may use, for example, a radiation source that emits $\alpha$ radiation, $\beta$ radiation, or $\gamma$ radiation, or even positron radiation.

A technical advantage of the present invention is that it recognizes the advantages of a problem that is inherent in packaging integrated circuits. That is, radioactive elements in electronic circuit packaging materials often include traces of uranium and thorium. These trace elements can seriously impair the operation of associated integrated circuits. This is due to the electron-hole pairs that radioactive particles can form in integrated circuits. By providing a method and system for advantageously applying the power from radioactive decay to power electronic circuitry, the present invention provides an attractive alternative power source for electronic circuitry.

Another technical advantage of the present invention is that it provides long-lived, inexpensive power for electronic circuitry from relatively minuscule amounts of radioactive material. Because of the magnitude of power per radioactive particle, only a very small amount of radioactive source material is necessary to produce a large number of electron-hole pairs. The large number of electron-hole pairs produces electrical current across the P-N junction to power electronic circuitry. In fact, a sufficient amount of shielding can be applied to the radioactive source to prevent radiation that the radioactive source emits from affecting associated electronic circuitry or from leaving the integrated circuit package.

Yet another technical advantage of the present invention is that the power cells may be formed in a variety of configurations or embodiments. For example, one embodiment includes the use of an array of power cells distributed and embedded within a semiconductor chip. This configuration can provide standby power in the event of a primary power source failure. Another embodiment includes growing a P-N junction around a trench within a semiconductor material and embedding a radioactive source in the trench. This aids in preventing the radioactive source from affecting any surrounding electronic circuitry. In still another embodiment, power cells appear on one side of a semiconductor chip, while active integrated circuitry appears on the opposite side. This also prevents the radioactive source from affecting associated electronic or integrated circuitry. The present invention, therefore, possesses this flexibility due in part to the small size requirements of the radioactive source.

Still another technical advantage of the present invention is that a wide variety of radioactive materials may be used as the radioactive source for emitting the radioactive particles. Thus, based on engineering design limitations, the present invention may use a long-lived, low-energy system for some applications. On the other hand, some applications may advantageously use relatively short-lived high-energy radioactive sources. Furthermore, based on differing engineering design objectives, it may be more advantageous to use $\beta$ or $\gamma$ radiation sources instead of $\alpha$ radiation sources. The present invention contemplates this degree of flexibility in the radiation source selection.

BRIEF DESCRIPTION OF THE DRAWINGS

The invention and its modes of use and advantages are best understood by reference to the following description of illustrative embodiments when read in conjunction with the accompanying drawings, wherein.

DETAILED DESCRIPTION OF THE INVENTION

Figure 1:
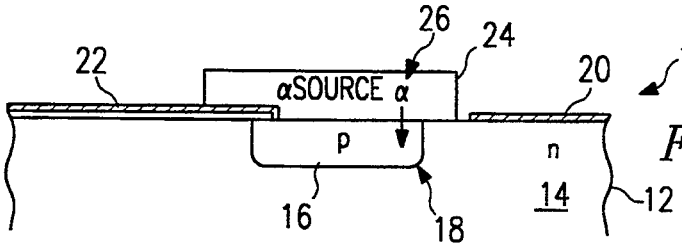
FIG. 1 shows one embodiment of the present invention as a simplified radioisotope power cell.

The various embodiments of the present invention are best understood by referring to the FIGUREs, wherein like numerals are used for like and corresponding parts of the various drawings.

Radioisotopes have tremendous power density that can be converted to electricity via P-N or N-P junctions. These could be put to use keeping SRAM cells alive or in making very lightweight batteries. But these are just some of the applications that the present invention addresses. The present invention, therefore, provides an internal radioisotope battery or power cell for integrated circuit memory and other low-power applications.

The energy density of radioisotopes is unparalleled by any chemical reaction such as those that conventional chemical batteries use. This relationship is based in physics and will hold true regardless of advances in power cell technology. The present invention recognizes the difference between these two physical regimes to provide a method and system to power integrated circuits by using a radioisotope associated with one or more P-N junctions. These power cells may be placed in association with an electronic circuit such as a data processing circuit as a standby power source so that a primary power failure will not destroy the contents of a memory, for example. The present invention may also prove practical in outer space applications to provide power to an entire system.

The problem of particulate radiation leaking into integrated circuitry and causing damage or power disruption is solved in the present invention by placing the power source at least twice the distance from the circuitry that the particles travel in the semiconductor material that forms part of the power cell. For example, by placing a power source that uses $\alpha$ radiation at least 50 microns from any circuitry in a silicon semiconductor material, no interruption or damage to associated circuitry occurs. This is because the distance an $\alpha$ particle can travel in silicon is 25 microns.

That a small amount of radioactive material can produce a great deal of power can be seen by the following example. An example of this phenomenon appears in the radioisotope $Am_{241}$, which has a half-life of 458 years. Suppose that a source composed of $Am_{241}$ is placed in association with a P-N junction of a silicon semiconductor material. The $\alpha$ particles leaving the radioactive material have an energy of 5.5 MeV per particle. In the semiconductor material, an electron-hole pair requires 3.6 eV to form. Thus, at the P-N junction $1.53\times10^6$ electron-hole pairs can form from each $\alpha$ particle traveling through the silicon semiconductor material. It can be shown using these principles that for every 0.23 grams of $\alpha$-producing radioisotope, one watt of energy can be produced in the semiconductor material. Based on this output and the charge requirements of a static RAM (SRAM) cell, it can also be shown that as little as 58 micrograms of $\alpha$-producing radioisotope are necessary to maintain the SRAM charge. The present invention can, therefore, use these small amounts of $\alpha$-producing radioactive isotopes to maintain SRAM charges in the event of a primarily power failure.

Notwithstanding design considerations such as voltage fluxuations, heat dissipation, and damage due to radioactive particles traveling through the semiconductor material, the present invention provides an attractive source of power for electronic circuitry. As yet a further example of the present inventions utility, one embodiment may provide an energy source that is easily adaptable to micromachines, micromotors, and general nanomechanics. Since $\alpha$ fluxations occur as $\sqrt{N}$ |N, voltage fluxations should not prohibit use of $\alpha$-producing radioisotopes in most applications. On the other hand, since radioisotopes produce approximately 2.5 watts of heat energy for every one watt of electrical energy, dissipating heat energy in the circuit is a design consideration. One solution, however, is to place the radioisotope power cell under a bond pad to both protect the associated circuitry and to make the pad and bond leads operate as a heat sink. Another alternative is to place the radioisotope on the reverse side of a chip or printed circuit board from that containing the integrated circuitry to protect the associated circuitry from potentially harmful $\alpha$ particles and allow for better heat dissipation.

FIG. 1 shows one power cell 10 of the present invention. In power cell 10, semiconductor material 12 includes an N material 14 and a P material 16 that form P-N junction 18. An equally useful scheme is to form an N-P junction with N material occupying the relative position of P material 16 and P material occupying the relative position of N material 14. Lead 20 electrically connects to N material 14, while lead 22 electrically connects to P material 16. Shown conceptually in FIG. 1, $\alpha$ source 24 covers N material 14 and P material 16 causing $\alpha$ particles 26 to travel into and through N material 14 and P material 16. This produces the desired electron-hole pairs. The internal fields of the P-N junction separate these pairs and allow the extraction of useful power through leads 20 and 22.

Power cell 10 of FIG. 1 may be formed first by diffusing P region 16 into N region 14 of semiconductor material 12. The $\alpha$ source 24, in this example, may be painted on or otherwise deposited on semiconductor material 12 using a wide variety of techniques available to semiconductor device manufactures. These include techniques such as vapor deposition, sputtering or thin film deposition, electroplating, and polymer bonding. Another method of forming a radioactive source may be to use a tape or polymer containing tritium as a $\beta$ particle emitting radioactive source, instead of an $\alpha$ particle emitting source. Leads 20 and 22 may be made of aluminum or other material to provide electrical connection from N material 14 and P material 16, respectively. The $\alpha$ source 24 may be an uranium, thorium, or other material or may be artificial isotope such as americium or californium. These sources are inexpensive and commercially available and are practical within the purpose of the present invention. Other radioisotope may be selected from the Handbook of Chemistry and Physics—56th, CRC Press (Cleveland, Ohio 1975), pp. B-252 through B-336, according to their half-lives, fission products, and other characteristics. It may be desirable to select $\alpha$ or $\beta$ emitters that do not emit $\gamma$ radiation. This is because $\gamma$ radiation are more difficult than is $\alpha$ or $\beta$ radiation.

Although embodiment 10 shows $\alpha$ source 24 as the radioactive source of one embodiment, other radioactive sources such as $\beta$ emitters or $\gamma$ emitters may be used within the scope of the present invention. What is important is to have a radioactive material that emits charged particles that travel through semiconductor material 12. Other design or engineering and environmental considerations may dictate the particular type of radioactive material to use. As a further example, one particularly attractive radioisotope is tritium. Tritium emits a $\beta$ particle that is absorbed very shallowly, and this permits semiconductor material 12 to have a very shallow P-N junction. In addition, the half-life of tritium is 12 years which for many power applications is advantageous. Tritium, therefore, is not as dangerous because its half-life is not long and it does not localize in the human body. That is, it is not ones of the more dangerous radioactive materials, whereas plutonium or other heavy materials produce physically damaging radioactive particles.

Figure 2:
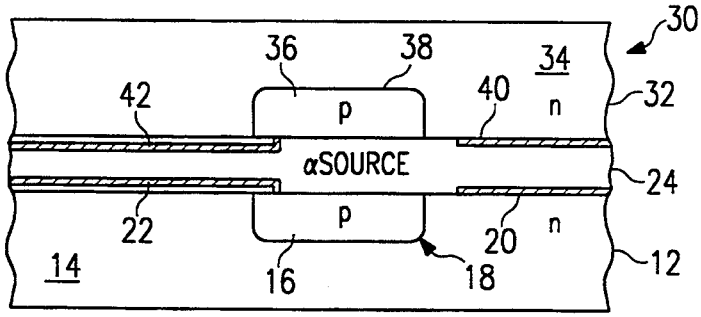
FIG. 2 shows another embodiment of the present invention in a sandwich-type power cell configuration.

FIG. 2 shows another power cell 30 of the present invention that forms a "sandwich-type" configuration with $\alpha$ source 24. In FIG. 2, semiconductor material 12 includes N material 14 and P material 16 each associated with P-N junction 18. Lead 20 connects electrically to N material 14, while lead 22 connects electrically to P material 16. On the opposite side of $\alpha$ radioactive source 24 appears semiconductor material 32 that includes N material 34 and P material 36 each associated with P-N junction 38. Lead 40 connects to N material 34 while lead 42 connects electrically to P material 36.

Because the $\alpha$ particles from $\alpha$ source 24 emit in all directions, those $\alpha$ particles that travel in a direction opposite that of particles 26 of FIG. 1 will not reach semiconductor material 12. In large part, power cell 30 of FIG. 2 addresses this situation. By forming a sandwich-type configuration, $\alpha$ particles that are emitted upwardly are captured by semiconductor material 32, while those that emitted downwardly are captured by semiconductor material 12. Leads 20 and 40 connect to N materials 14 and 34, respectively. Likewise, leads 22 and 42 connect to P materials 16 and 36, respectively. Forming power cell 30 of FIG. 2 is similar to forming power cell 10 of FIG. 1. An exception to this statement is that $\alpha$ source 24 may fully cover P material 16 and N material 14. Over $\alpha$ material 24 leads 40 and 42 may be formed, after which semiconductor material 32 may be formed to include P material 36 and N material 34. A variety of well-established techniques may be employed to form the sandwich-type embodiment 30 of FIG. 2.

Figure 3:
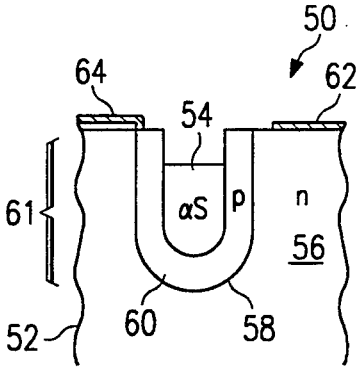
FIG. 3 shows yet another embodiment of the present invention as a power cell within a trench of a semiconductor material.

FIG. 3 shows a further power cell trench configuration 50 of the present invention wherein semiconductor material forms a trench 61 for receiving $\alpha$ source 54. In particular, N material 56 of semiconductor 52 forms P-N junction 58 with P material 60. Lead 62 electrically connects to N material 56, while lead 64 electrically connects to P material 60.

The trench power cell 50 of FIG. 3 may have particular application in forming integrated circuits that use DRAMS. The P material 60 may be formed, for example, in a trench shape that is several microns deep and approximately 3 microns wide. By diffusing P material 60 within trench 61, the desired configuration is achieved. Placing contact 64 in connection with P material 60 and lead 62 in connection with N material 56 has the effect of trapping $\alpha$ radiation-producing source 54 within trench 61 so that little or no radiation passes through semiconductor material 52 to contaminate circuitry or other things on the top or associated with the top portion of semiconductor material 52. The trench 61 of FIG. 3 provides an aspect ratio of approximately 20:1 so that the likelihood of radiation passing out of trench 61 is essential zero. The trench configuration 50 of FIG. 3 may also be placed under a bond pad to provide a significant amount of power to an associated circuit with essentially no harmful effects to the associated integrated circuitry.

Figure 4:
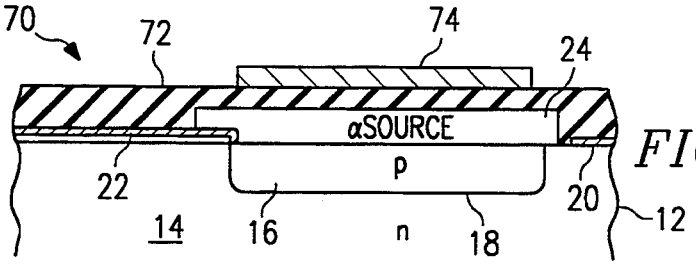
FIG. 4 shows a further embodiment of the present invention where a power cell appears beneath an integrated circuit bond pad.

FIG. 4 shows a further application 70 of the present invention. In particular, semiconductor material 12 includes N material 14 that forms with P material 16 a P-N junction 18. Lead 20 connects to N material 14, while lead 22 electrically connects to P material 16. The $\alpha$ source material 24 covers semiconductor material 12. In addition, oxide layer 72 covers $\alpha$ source material 24. Bond pad 74 covers $\alpha$ source 24.

The application 70 of FIG. 4 is a design that may be used with bond pad 74 over oxide layer 72. Because bond pad 74 is typically large and consumes a considerable amount of surface area, a power cell using $\alpha$ source 24 over P-N junction 18 could serve as a small standby power source. While this configuration may not generate a substantial amount of current, it may provide a trickle amount of current to keep circuit information stored in the event of a loss of primary power. In CMOS circuits, very small amounts of current are necessary to maintain stored information in a circuit. The application 70 of FIG. 4, therefore, provides a trickle amount of current that would be sufficient to maintain a charge on certain components, such as SRAM or other memory device of a CMOS integrated circuit. In addition, the power cell in configuration 70 may be placed on the back of semiconductor chip without disrupting the operation of the associated integrated circuitry. This concept is shown even more clearly in FIG. 5.

Figure 5:
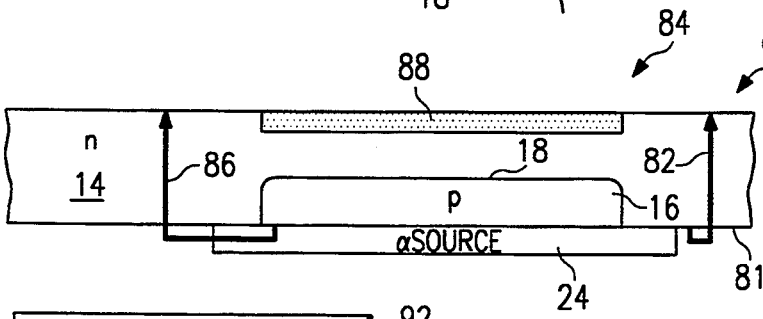
FIG. 5 shows an application of the present invention that protects active integrated circuitry on a printed circuit board.

FIG. 5 shows a further application 80 of the present invention. In FIG. 5, semiconductor material 12 includes N material 14 and P material 16 in association with P-N junction 18. Lead 82 connects to N material 14 and passes through to surface 84 of semiconductor material 12. Likewise, lead 86 connects to P material 16 through semiconductor material 12 to top side 84. Application 80 of FIG. 5 protects active circuitry 88 from potentially harmful $\alpha$ particles of $\alpha$ source 24 by physically isolating the source such a distance from the circuitry that no particles can hit the circuitry.

The FIG. 5 application 80 makes use of what would most likely be an otherwise unused backside 81 of semiconductor material 12. Placing $\alpha$ source 24 over P material 16 and placing holes for leads 82 and 86 through semiconductor material 12 permits leads to go from N material 14 and P material 16 to active circuitry 88. A large number of such sources could be placed on semiconductor material 12 to provide standby power to active circuitry 88, for example. This is shown more particularly in FIG. 6.

Figure 6:
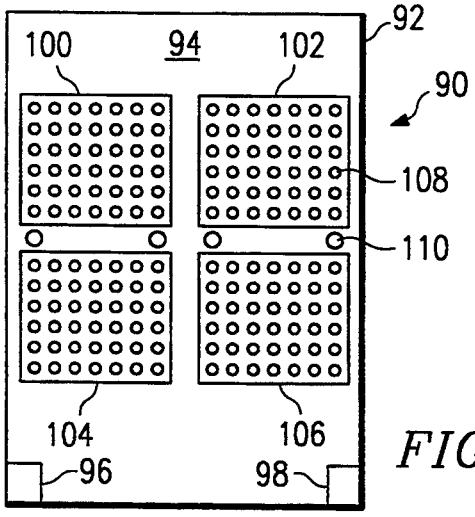
FIG. 6 shows a further embodiment of the present invention that uses a plurality of smaller power cells in a semiconductor chip.

FIG. 6 shows yet another application of the present invention in the form of power cell array 90 that includes semiconductor chip 92 having embedded within it numerous micropower cells for powering associated electronic circuitry. For example, electronic semiconductor chip 92 includes substrate 94 embedded within which are larger power cells 96 and 98 that may be positioned under the bond pads in a configuration similar to that shown in FIG. 4. Also, on semiconductor chip 92 are arrays 100, 102, 104, and 106 that include microminiature radioactive sources such as power cell 108. Power cell 108 may be used to provide standby power to circuitry that may subsequently be placed on semiconductor chip 92. Silicon semiconductor chip 92 even further includes radioactive sources such as radioactive sources 110 that are miniature sources to provide more power than the power cell 108 but not the amount of power available from bond-pad power cells 96 and 98.

Power cell array 90 of FIG. 6 may be used to support a complicated integrated circuit. For example, if an associated integrated circuit includes static RAMs, SRAMs power cell array 90 has the ability to maintain a charge on the static RAMs by providing very tiny trickle currents to the static RAMs. By depositing power cells 108 in arrays such as array 100, 102, 104, and 106, circuitry on the opposite side of power cell array 90 can be energized so that information in the SRAMs or other memory circuitry is not lost upon a failure of the primary power source. Because of the high energy density and lower power requirements of such integrated circuit devices, each power cell 108 may be on the order of a cubic micron or smaller. Depending on whether $\alpha$ particles, $\beta$ particles, or $\gamma$ particles are used to provide power, different size power cells 108 may be used.

Figure 7:
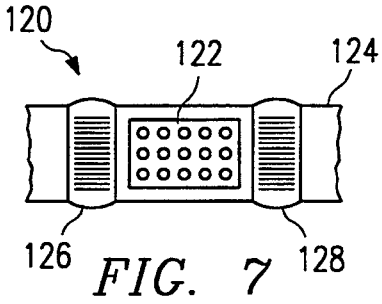
FIG. 7 shows yet another application of one embodiment of the present invention for use in conjunction with a plurality of spherical solar cells to power associated circuitry.

FIG. 7 shows yet a further application 120 of the present invention that embeds an array such as array 122 within a semiconductor substrate 124. Semiconductor substrate 124 includes solar cells 126 and 128. Power cell array 122 is positioned between solar cells 126 and 128 and may electrically connect with associated circuitry that provide standby power to circuitry associated with semiconductor material 124 in the event of insufficient photon energy to generate amounts of power from solar cells 126 and 128 that the associated circuit may require.

Invented by TI research engineers Jules Levine, Millard Jensen, Milford Hammerbocker and Gregg Hodgekiss, spherical solar cells possess a broad range of applications. Solar spherical technology can bring low-cost, reliable electrical power to remote areas and serve as an energy source for industrial telecommunications. U.S. Pat. No. 4,637,855 and its progery by Levine, et al. is assigned to Texas Instruments Incorporated, describes the use of solar spherical cells, and is here incorporated by reference to provide examples of these types of crystalline silicon spheres. The power cell array 122 of the present invention, therefore, improves the operation of solar cells 126 and 128, to provide a minimum amount of current in the event of insufficient solar energy to provide the necessary power to associated circuitry.

OPERATION

Although it is clear how the radioisotope power cells of the various above embodiments operate, for completeness, the following describes how one embodiment produces electrical current. Referring, for example, to FIG. 1, power cell 10 generates power by an $\alpha$ source 24, such as $Am_{241}$, directing $\alpha$ particles 26 into P material 16 and N material 14. Each $\alpha$ particle 26 can deposits six MeV into semiconductor material 12. As the $\alpha$ particles 26 travel through semiconductor material 12, they form electron-hole pairs. In fact, from each $\alpha$ particle approximately $1.6\times10^6$ electron-hole pairs may form. The electron-hole pairs are swept to their corresponding sides of P-N junction 18 to form electrons in N material 14 and holes in P material 16, thereby causing a current to flow across P-N junction 18. This causes current to flow through leads 20 and 22. This current may be used for powering associated electronic circuitry.

In summary, therefore, the present invention provides an electrical power source in the form of radioisotope power cells that include a semiconductor material and at least one P-N junction within the semiconductor material. A radioactive source is associated with the P-N junction and emits electrically-charged radioactive particles into the semiconductor material. This produces electron-hole pairs in the semiconductor material. As the electron-hole pairs form, they generate an electrical current that passes through the P-N junction to cause electrical current to flow through leads 20 and 22 and from electrical source 10. The radioactive particles may be $\alpha$ particles, $\beta$ particles, $\gamma$ particles or other radioactive particles.

A technical advantage of the present invention is that it provides long-lived, inexpensive power from relatively minuscule amounts of radioactive material to provide power to electronic circuitry. Because of the large magnitude of deposited energy per radioactive decay, only a very small amount of the radioactive source material is necessary to produce a sufficiently large number of electron-hole pairs to power electronic circuitry connected with the power cells. Therefore, a sufficient amount of shielding can be applied to the radioactive source to prevent radiation emitting from the radioactive source from affecting associated electronic circuitry.

Yet another technical advantage of the present invention is that the power cells may be formed in a variety of configurations or embodiments for the purpose of different applications. For example, one embodiment includes the use of an array of power cells distributed and embedded within an electronic circuit board for providing standby power in the event of a primary power source failure. Another embodiment includes embedding the radioactive power source in a trench formed of a P-N junction within a semiconductor material. This also will discretely configure the radioactive power source. Still another embodiment has the power cells on one side of a semiconductor chip while active integrated circuitry appears on the opposite side. This will also prevent the radioactive source from affecting the integrated circuitry. This flexibility is due primarily to the small size requirements of the radioactive source.

Still another technical advantage of the present invention is that a wide variety of radioactive materials may be used as the radioactive source for emitting the radioactive particles. Thus, based on engineering design limitations, the present invention may use a long-lived, low-energy system for some applications. Other applications may require short-lived high-energy radioactive sources. Furthermore, based on the engineering design objectives, it may be more advantageous to use $\beta$ or $\gamma$ radiation sources instead of $\alpha$ radiation sources. The present invention contemplates this degree of flexibility in radiation source selections.

The above description and the accompanying drawings, therefore, are merely illustrative of the application of the principals of the present invention and are not limiting. Numerous other embodiments are arrangements which employ the principals of the invention and which fall within its spirit and scope may be readily devised by those skilled in the art. Accordingly, the invention is not limited by the foregoing description, but by the scope of the appended claims.

What is claimed is:

1. A radioisotopic power source comprising:

a substrate of semiconductor material, said substrate including integrated circuitry formed therein;

a trench formed in said substrate;

a PN junction formed along the wall of said trench;

a first power lead connected to the P portion of said PN junction;

a second power lead connected to the N portion of said PN junction; and a radioactive source deposited in said trench.

2. The radioisotopic power source of claim 1, wherein said radioactive source comprises an $\alpha$ particle emitting radioactive source.

3. The radioisotopic power source of claim 1, wherein said radioactive source comprises a $\beta$ particle emitting radioactive source.

4. The radioisotopic power source of claim 1, wherein said radioactive source comprises a photon emitting radioactive source.

5. The radioisotopic power source of claim 1, wherein said radioactive source comprises a charged particle emitting radiation source.

* * * * *